US006026897A

United States Patent [19]

Pringle et al.

[11] Patent Number: 6,026,897

[45] Date of Patent: Feb. 22, 2000

[54] COMMUNICATION CONDUIT IN A WELL TOOL

[75] Inventors: Ronald E. Pringle, Houston; Arthur J. Morris, Magnolia, both of Tex.

[73] Assignee: Camco International Inc., Houston, Tex.

[21] Appl. No.: 08/969,867

[22] Filed: Nov. 14, 1997

Related U.S. Application Data

[60] Provisional application No. 60/030,918, Nov. 14, 1996.

[51] Int. Cl.[7] ..... E21B 17/10; E21B 17/18; E21B 33/128; E21B 33/129

[52] U.S. Cl. ..... 166/65.1; 166/120; 166/129; 166/242.1; 166/242.3

[58] Field of Search ..... 166/65.1, 129, 166/120, 179, 242.1, 242.3

[56] References Cited

U.S. PATENT DOCUMENTS

| | | | |
|---|---|---|---|
| 3,196,948 | 7/1965 | Dye . | |
| 3,716,101 | 2/1973 | McGowen, Jr. et al. | 166/60 |
| 3,734,179 | 5/1973 | Smedley | 166/106 |
| 3,899,631 | 8/1975 | Clark | 166/187 |
| 4,022,273 | 5/1977 | Marathe | 166/129 X |
| 4,487,258 | 12/1984 | Jackson et al. | 166/120 |
| 4,616,704 | 10/1986 | Johnston | 166/242.3 |
| 4,798,243 | 1/1989 | Curington et al. | 166/65.1 |
| 4,799,544 | 1/1989 | Curlett | 166/65.1 |
| 4,917,187 | 4/1990 | Burns et al. | 166/297 |
| 5,095,978 | 3/1992 | Akkerman et al. | 166/120 |
| 5,253,705 | 10/1993 | Clary et al. | 166/123 |
| 5,334,801 | 8/1994 | Mohn | 166/65.1 X |
| 5,337,808 | 8/1994 | Graham | 166/191 |
| 5,479,991 | 1/1996 | Robison et al. | 166/387 |
| 5,493,626 | 2/1996 | Schultz et al. | 385/101 |
| 5,505,263 | 4/1996 | White et al. | 166/374 |
| 5,542,472 | 8/1996 | Pringle et al. | 166/65.1 |
| 5,586,601 | 12/1996 | Pringle | 166/212 |
| 5,803,170 | 9/1998 | Garcia-Soule et al. | 166/242.3 |

FOREIGN PATENT DOCUMENTS

| | | |
|---|---|---|
| 0289673A1 | 11/1988 | European Pat. Off. . |
| WO 94/28450 | 12/1994 | WIPO . |

OTHER PUBLICATIONS

Camco Products & Services Co., Packers and Completion Accessories Catalog, pp. 24–27, 1986.

*Primary Examiner*—George Suchfield
*Attorney, Agent, or Firm*—Tabor, Goldstein & Healey, LLP

[57] ABSTRACT

An improved apparatus for transmitting signals through a well tool is provided. In a broad aspect, the present invention is a communication conduit in a well tool comprising: a cylindrical mandrel having a longitudinal bore therethrough, an inner diameter, an outer diameter, and an outside circumference; a well tool attached to the outside circumference of the cylindrical mandrel; and at least one signal transmitting passageway positioned in the mandrel between the inner diameter and the outer diameter. In a specific embodiment, the well tool may be a packer. The at least one signal transmitting passageway may be used as a carrier for electrical or fiber optic conductors, or it may be a pressure retaining member whereby pressurized hydraulic fluid may be passed through to a device below the well tool without interruption.

20 Claims, 4 Drawing Sheets

COMMUNICATION CONDUIT IN A WELL TOOL

RELATED APPLICATIONS

This application claims the benefit of U.S. Provisional Application Ser. No. 60/030,918, filed Nov. 14, 1996.

BACKGROUND OF THE INVENTION

1. Field of the Invention

The present invention relates to devices used in hydrocarbon producing wells, and more specifically, to devices that are used to enhance the production of these wells by utilizing a means of communication from a surface control panel to one or more downhole devices.

2. Description of the Related Art

Completion systems are well known in the art of well production, and can take many varied forms. The present invention is directed to completion systems that can be enhanced by having a means to communicate with downhole devices. A control panel at the earth's surface may send signals to downhole devices to cause some specific action, i.e., a valve opens, a sleeve shifts, an electric motor is turned on or off, or any other well known action typically performed by completion devices. Also, data may be collected downhole and transmitted to the surface control panel. This data may include pressure or temperature readings, flowing velocities or volumes, or indications that an action in a downhole device was accomplished. Signals transmitted to and from the surface control panel may be electrically conducted through a wire, or hydraulically conducted by a pressure signal in a control conduit, or may be conducted by fiber optic technology.

Well completions typically have as common elements: a casing cemented in the well extending from a surface wellhead to the producing formation; a production tubing located concentrically inside the casing; and one or more well known devices (commonly called packers) that block, pack off, and seal the annulus formed between the casing and the production tubing generally by a resilient sealing element. Placement of the packer in this way directs production inside the tubing. For the surface control panel to communicate with completion devices in the well, a conductor connecting the control panel and the device is typically placed in the annulus. For devices above the packer this is easily accomplished since the annulus is unobstructed. However, it is this packer that presents an obstacle to communicating with devices below since it blocks the passageway that the conductors follow.

Prior art devices to allow communication below the packer generally focus on feeding the conductor through the resilient sealing element. This makes complex and expensive connectors necessary to isolate the conductor from downhole wellbore fluids.

There is a need for a novel simplified apparatus to allow conductor lines to traverse well tools while maintaining a reliable isolation from wellbore fluids.

SUMMARY OF THE INVENTION

The present invention has been contemplated to overcome the foregoing deficiencies and meet the above-described needs.

The invention comprises one or more conduits or channels formed in a rigid portion (or mandrel) of a well tool, the configuration of which allows a conductor to traverse the well tool in the least complex and problematic manner. The present invention also has the advantage of being adaptable to conventional tool geometry and existing designs, which minimizes the time and cost of bringing the product to market. The channel may be used as a carrier for electrical or fiber optic conductors, or it may be a pressure retaining member, whereby pressurized hydraulic fluid is passed through the tool without interruption.

In one aspect, the present invention is a communication conduit in a well tool comprising: a cylindrical mandrel having a longitudinal bore therethrough, an inner diameter, an outer diameter, and an outside circumference, a well tool attached to the outside circumferences of the cylindrical mandrel, and at least one signal transmitting passageway positioned in the mandrel between the inner diameter and the outer diameter. Another feature of this aspect of the present invention is that at least two signal transmitting passageways may be positioned between the inner and outer diameters. Another feature of this aspect of the present invention is that the signal transmitting passageway may be formed to conduct hydraulic fluid. Another feature of this aspect of the present invention is that the signal transmitting passageway may include at least one electric wire. Another feature of this aspect of the present invention is that the signal transmitting passageway may include at least one fiber optic cable. Another feature of this aspect of the present invention is that the signal transmitting passageway may be positioned approximately midway between the inside diameter and the outside diameter of the mandrel. Another feature of this aspect of the present invention is that the cross sectional area of the signal transmitting passageway may be oval shaped with a major axis and a minor axis with the major axis extending radially. Another feature of this aspect of the present invention is that the signal transmitting passageway may be substantially elliptical. Another feature of this aspect of the present invention is that the length of the major axis may be substantially no greater than twice the length of the minor axis. Another feature of this aspect of the present invention is that a first communication conduit may be connected between a control panel at the earth's surface and the at least one signal transmitting passageway in the mandrel. Another feature of this aspect of the present invention is that at least one signal may be transmitted from the first communication conduit through the at least one signal transmitting passageway in the mandrel to a second communication conduit, the second communication conduit being connected to a device below the packer.

In another aspect, the present invention may be a combination of a cylindrical mandrel and a signal transmitting passageway for conducting hydraulic fluid to actuate well tools comprising: a cylindrical mandrel having a longitudinal bore therethrough, an inner diameter, an outer diameter, and an outside circumference; and at least one signal transmitting passageway positioned in said mandrel between the inner diameter and the outer diameter.

In another aspect, the present invention may be a combination of a cylindrical mandrel and a signal transmitting passageway for transmitting signals to actuate well tools comprising: a cylindrical mandrel having a longitudinal bore therethrough, an inner diameter, an outer diameter, and an outside circumference; at least one signal transmitting passageway positioned in the mandrel between the inner diameter and the outer diameter; and an electric wire traversing the mandrel through the signal transmitting passageway.

In another aspect, the present invention may be a combination of a cylindrical mandrel and a signal transmitting passageway for transmitting signals to actuate well tools comprising: a cylindrical mandrel having a longitudinal bore therethrough, an inner diameter, an outer diameter, and an outside circumference; at least one signal transmitting passageway positioned in the mandrel between the inner diameter and the outer diameter; and a fiber optic cable traversing the mandrel through the signal transmitting passageway.

In another aspect, the present invention may be an improved packer comprising: a first nipple having a longitudinal bore therethrough; a first set of slips having inner surfaces and being connected to the first nipple and mating with a first gripping member; a resilient sealing element having a longitudinal bore therethrough, and a first end connected to the first set of slips; a body member connected to a second end of the resilient sealing element; a piston having a longitudinal bore therethrough and being disposed for longitudinal movement within the body member; a second nipple having a longitudinal bore therethrough and being connected to the body member; and a cylindrical mandrel having a longitudinal bore therethrough, an inner diameter, an outer diameter, an outside circumference, and at least one signal transmitting passageway positioned in the mandrel between the inner diameter and the outer diameter, the outside circumference being disposed within: the longitudinal bore of the first nipple; the inner surfaces of the first set of slips; the longitudinal bore of the resilient sealing element; the longitudinal bore of the piston; and the longitudinal bore of the second nipple. Another feature of this aspect of the present invention is that the packer may further include a second set of slips for mating with a second gripping member, the second set of slips having inner surfaces and being connected between the body member and the second nipple, the outside circumference of the mandrel being further disposed within the inner surfaces of the second set of slips. Another feature of this aspect of the present invention is that a first communication conduit may be connected between a control panel at the earth's surface and the at least one signal transmitting passageway in the mandrel. Another feature of this aspect of the present invention is that at least one signal may be transmitted from the first communication conduit through the at least one signal transmitting passageway in the mandrel to a second communication conduit, the second communication conduit being connected to a device below the packer. Another feature of this aspect of the present invention is that the mandrel may include: a first hydraulic passageway, a second hydraulic passageway, a fiber optic passageway, and an electric passageway; the first hydraulic passageway establishing fluid communication between the piston and a source of hydraulic fluid above the packer; the second hydraulic passageway establishing fluid communication between a source of hydraulic fluid above the packer and at least one device below the packer; the fiber optic passageway providing a channel for passing at least one fiber optic cable from above the packer to at least one device below the packer; and the electric passageway providing a channel for passing at least one electrical conductor from above the packer to at least one device below the packer. Another feature of this aspect of the present invention is that a first communication conduit may connected between a control panel at the earth's surface and the packer, the first communication conduit including a first hydraulic conduit, a second hydraulic conduit, at least one fiber optic cable, and at least one electrical conductor, and the mandrel may include a first hydraulic passageway in communication with the first hydraulic conduit in the first communication conduit, a second hydraulic passageway in communication with the second hydraulic conduit in the first communication conduit, a fiber optic passageway through which the at least one fiber optic cable passes, and an electric passageway through which the at least one electrical conductor passes. Another feature of this aspect of the present invention is that a second communication conduit may be connected between the packer and a device below the packer, the second communication conduit including a hydraulic conduit, at least one fiber optic cable, and at least one electrical conductor, the second hydraulic passageway in the mandrel being in fluid communication with the hydraulic conduit in the second communication conduit, the at least one electrical conductor passing through the electric passageway in the mandrel being connected to the at least one electrical conductor in the second communication conduit, and the at least one fiber optic cable passing through the fiber optic passageway in the mandrel being connected to the at least one fiber optic cable in the second communication conduit.

After examination of the enclosed drawings, one skilled in the art of well completions will immediately see the value of this invention to packers and pack off devices, and also to any well known completion tool where communication thereacross may be advantageous. This might include but not be limited to subsurface safety valves, landing nipples, sliding sleeves, unions and separation tools. Use of this device enhances the economics of wells and allows the hydrocarbon resources to be more completely exploited.

Figure 1A:
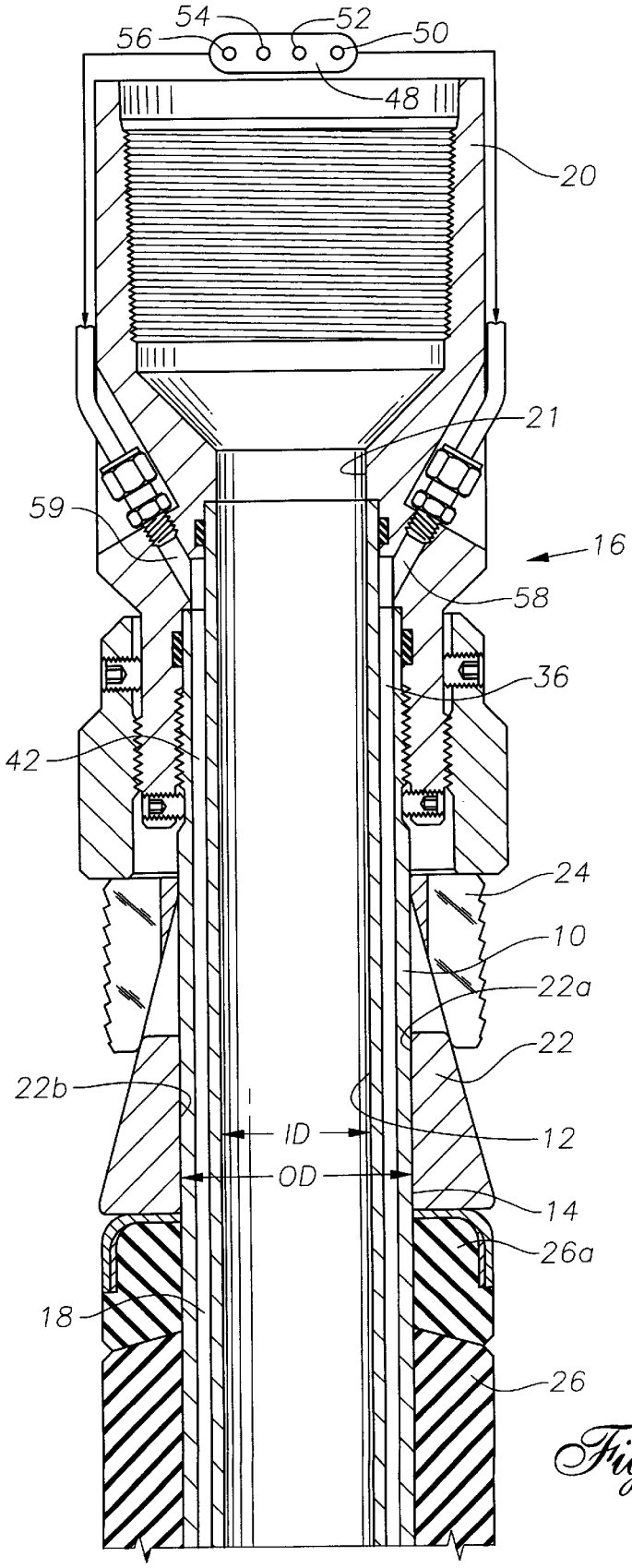
FIGS. 1A–1C illustrate a longitudinal cross-sectional view of the present invention.

While the invention will be described in connection with the preferred embodiments, it will be understood that it is not intended to limit the invention to those embodiments. On the contrary, it is intended to cover all alternatives, modifications, and equivalents as may be included within the spirit and scope of the invention as defined by the appended claims.

DETAILED DESCRIPTION OF THE INVENTION

Referring to the drawings in detail, wherein like numerals denote identical elements throughout the several views, the present invention will now be described with reference to FIGS. 1A–1C and 2.

In a broad aspect, as shown in FIG. 1A, the present invention is a communication conduit in a well tool comprising: a cylindrical mandrel 10 having a longitudinal bore 12 therethrough, an inner diameter ID, an outer diameter OD, and an outside circumference 14; a well tool 16 attached to the outside circumference 14 of the cylindrical mandrel 10; and at least one signal transmitting passageway 18 positioned in the mandrel 10 between the inner diameter ID and the outer diameter OD. In a specific embodiment, the well tool 16 may be a packer. While the embodiment depicted in FIGS. 1A–1C and 2 is a permanently-mounted packer, use of the present invention with a retrievable packer, or other well tools, is intended to be within the scope and spirit of the invention.

In a specific embodiment, the packer 16 may broadly include: a first nipple 20 having a longitudinal bore 21; a first set of slips 22 having inner surfaces 22*a* and 22*b*, the slips 22 being connected to the first nipple 20 and mating with a first gripping member 24; a resilient sealing element 26 having a longitudinal bore 31 and a first end 26*a* connected to the first set of slips 22; a body member 27 connected to a second end 26*b* of the resilient sealing element 26; a piston 28 having a longitudinal bore 29 and being disposed for longitudinal movement within the body member 27; a second set of slips 30 having inner surfaces 30*a* and 30*b*, the slips 30 being connected to the body member 27 for mating with a second gripping member 32; and a second nipple 34 having a longitudinal bore 35 and being connected to the second set of slips 30. As stated above, in a specific embodiment, the packer 16 is attached to the outside circumference 14 of the cylindrical mandrel 10. More particularly, the outside circumference 14 of the mandrel 10 is disposed within: the longitudinal bore 21 of the first nipple 20; the inner surfaces 22*a* and 22*b* of the first set of slips 22; the longitudinal bore 31 of the resilient sealing element 26; the longitudinal bore 29 of the piston 28; the inner surfaces 30*a* and 30*b* of the second set of slips 30; and the longitudinal bore 35 of the second nipple 34.

Figure 1B:
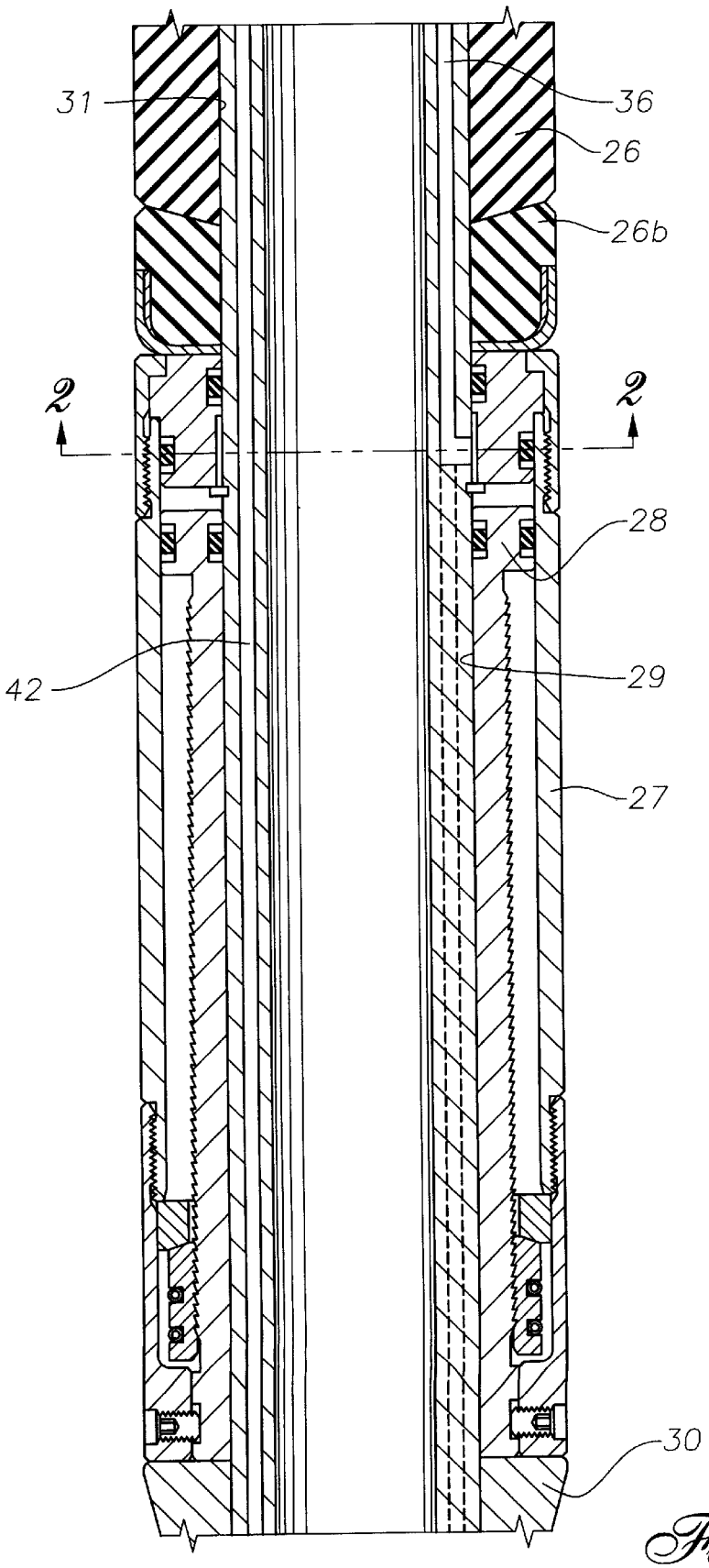
Figure 2:
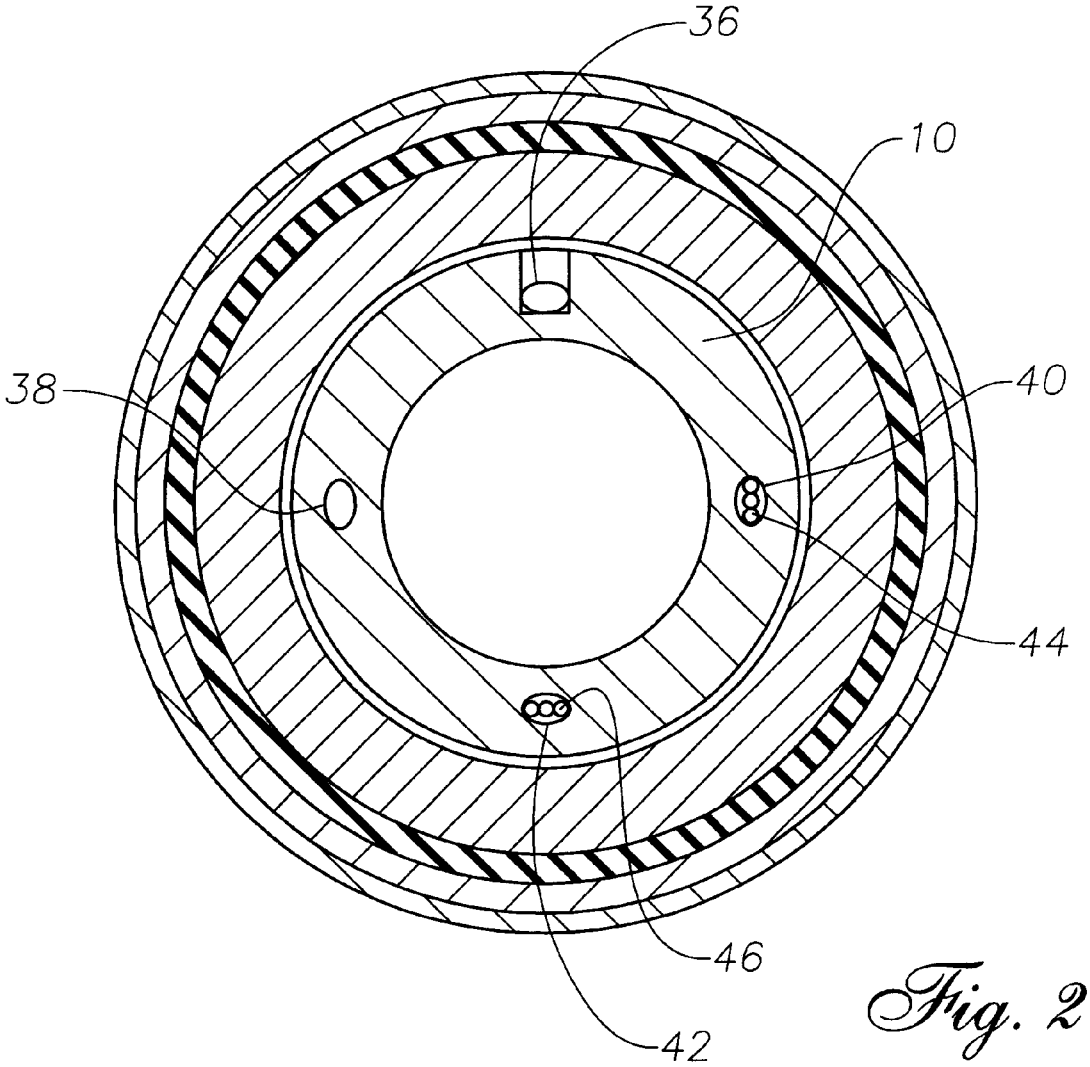
FIG. 2 is a cross-sectional view taken along line 2—2 of FIG. 1B.

As stated above, the mandrel 10 includes at least one signal transmitting passageway 18. As shown in FIG. 2, which is a cross-sectional view taken along line 2—2 of FIG. 1B, in a specific embodiment, the mandrel 10 may include four signal transmitting passageways, namely, a first hydraulic passageway 36, a second hydraulic passageway 38, a fiber optic passageway 40, and an electric passageway 42. As will be explained more fully below, all of these passageways, except for the first hydraulic passageway 36, extend all the way longitudinally through the mandrel 10. In a specific embodiment, the fiber optic passageway 40 may include at least one fiber optic cable 44, the electric passageway 42 may include at least one electric wire 46, and the hydraulic passageways 36 and 38 may be pressure retaining members formed to conduct hydraulic fluid.

Referring to FIG. 1A, a first communication conduit 48 runs from a control panel at the earth's surface (not shown) and connects to the first nipple 20 of the packer 16. In this specific embodiment, the first communication conduit 48 includes a first hydraulic conduit 50, a second hydraulic conduit 52, at least one fiber optic cable 54, and at least one electrical conductor 56. In a specific embodiment, the first nipple 20 includes a separate conduit for establishing communication between the four components 50–56 of the communication conduit 48 with the signal transmitting passageways 36—42 in the mandrel 10. In particular, the first hydraulic conduit 50 in the communication conduit 48 is connected to a first conduit 58 in the first nipple 20 to establish fluid communication with the first hydraulic passageway 36 in the mandrel 10. As noted above, in this embodiment, the first hydraulic passageway 36 does not extend the full length of the mandrel 10, but, instead, as shown in FIG. 1B, exits the mandrel 10 at its outer circumference 14 adjacent the piston 28. The function of the first hydraulic passageway 36 is to supply hydraulic fluid to actuate the piston 28 and thereby actuate the packer 16.

The other three components 52–56 of the first communication conduit 48 are in communication via a corresponding conduit in the nipple 20 with the other three signal transmitting passageways 38–42. In particular, with reference to FIG. 1A, the at least one electrical conductor 56 in the first communication conduit 48 passes through a second conduit 59 in the first nipple 20 and into the electric passageway 42 in the mandrel 10. The first nipple 20 is further provided with a third conduit (not shown) for establishing fluid communication between the second hydraulic conduit 52 in the first communication conduit 48 and the second hydraulic passageway 38 in the mandrel 10, and a fourth conduit (not shown) through which the at least one fiber optic cable 54 in the first communication conduit 48 is passed into the fiber optic passageway 40 in the mandrel 10. As such, the components 52–56 within the first communication conduit 48 are in communication via corresponding conduits in the nipple 20 with the three signal transmitting passageways 38–42 that extend the full length of the mandrel 10.

Figure 1C:
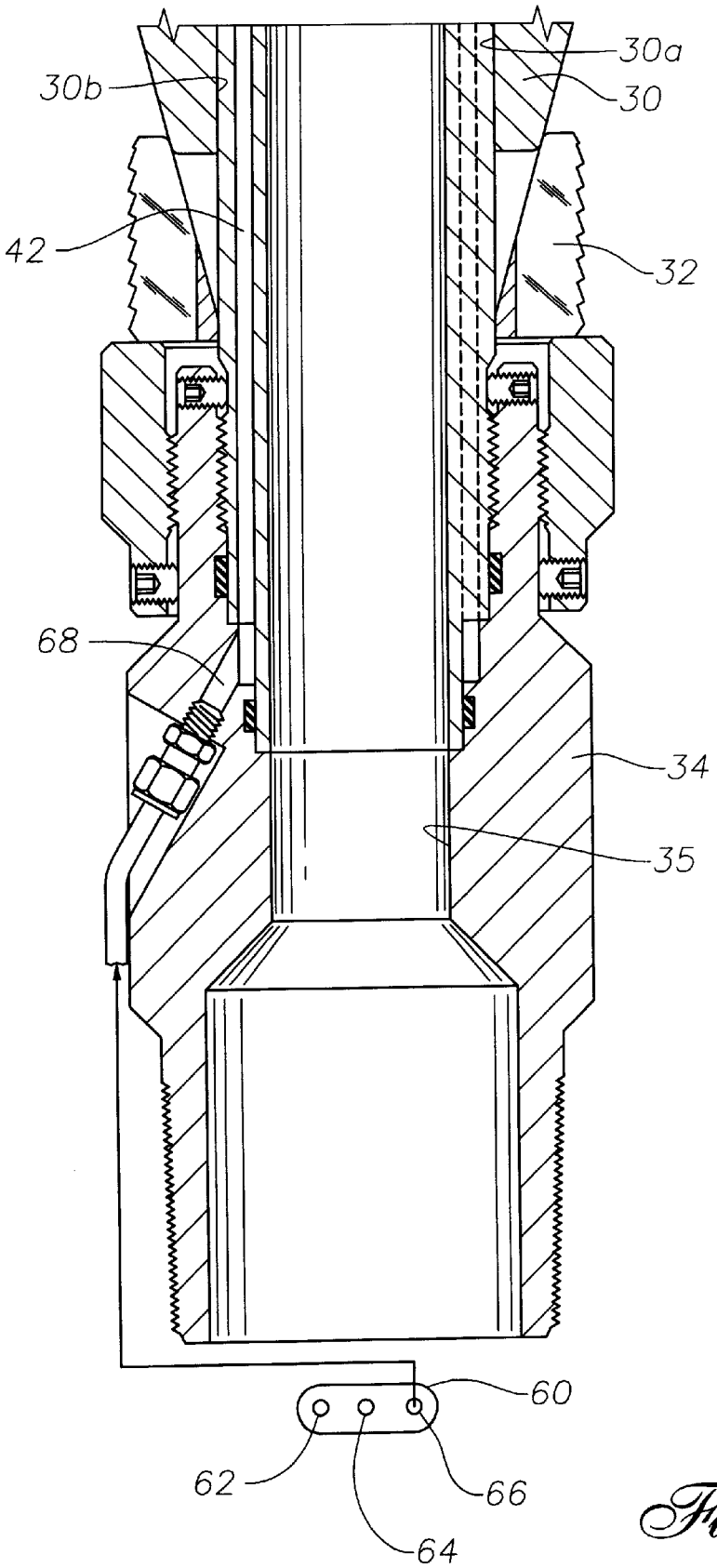

With reference to FIG. 1C, the three signal transmitting passageways 38–42 that extend the full length of the mandrel 10 are connected to a second communication conduit 60 in the same manner as discussed above regarding the first communication conduit 48. In a specific embodiment, the second communication conduit 60 may include a hydraulic conduit 62, at least one fiber optic cable 64, and at least one electrical conductor 66. The at least one electrical conductor 56 in the first communication conduit 48 passing through the electric passageway 42 in the mandrel 10 is connected through a first conduit 68 in the second nipple 34 to the at least one electrical conductor 66 in the second communication conduit 60. The second nipple 34 is further provided with a second conduit (not shown) for establishing fluid communication between the second hydraulic passageway 38 in the mandrel 10 and the hydraulic conduit 62 in the second communication conduit 60, and a third conduit (not shown) for connecting the at least one fiber optic cable 54 in the first communication conduit 48 passing through the fiber optic passageway 40 in the mandrel 10 with the at least one fiber optic cable 64 in the second communication conduit 60.

The signals transmitted through the packer 16 via the signal transmitting passageways 3642 to the second communication conduit 60 are then available for connection to and control of devices below the packer 16. The device may be a well tool or any instrument used for collecting data within a well, as understood by those of ordinary skill in the art. For example, the conduit 60 may be connected to an instrument such as a temperature gauge, a pressure gauge, or volume flow meter, located below the packer 16, for collecting and relaying well data to the control panel at the earth's surface.

It is to be understood that the invention is not limited to the exact details of construction, operation, exact materials or embodiments shown and described, as obvious modifications and equivalents will be apparent to one skilled in the art. Accordingly, the invention is therefore to be limited only by the scope of the appended claims.

We claim:

1. A communication conduit in a well tool comprising:

a mandrel having a longitudinal bore therethrough, an inner diameter, an outer diameter, and an outside circumference, a well tool attached to the outside circumference of the mandrel, and at least two signal transmitting passageways positioned in the mandrel between the inner diameter and the outer diameter.

2. The communication conduit of claim 1, wherein at least one of the signal transmitting passageways is formed to conduct hydraulic fluid.

3. The communication conduit of claim 1, wherein at least one of the signal transmitting passageways includes at least one electric wire.

4. The communication conduit of claim 1, wherein at least one of the signal transmitting passageways includes at least one fiber optic cable.

5. The communication conduit of claim 1, wherein at least one of the signal transmitting passageways is positioned approximately midway between the inside diameter and the outside diameter of the mandrel.

6. The communication conduit of claim 1, wherein the cross sectional area of at least one of the signal transmitting passageways is oval shaped with a major axis and a minor axis with the major axis extending radially.

7. The communication conduit of claim 6, wherein the at least one signal transmitting passageway is substantially elliptical.

8. The communication conduit of claim 6, wherein the length of the major axis is substantially no greater than twice the length of the minor axis.

9. The communication conduit of claim 1, wherein a first communication conduit is connected between a control panel at the earth's surface and the at least two signal transmitting passageways in the mandrel.

10. The communication conduit of claim 9, wherein at least one signal is transmitted from the first communication conduit through one of the signal transmitting passageways in the mandrel to a second communication conduit, the second communication conduit being connected to a device below the packer.

11. A combination of a mandrel and at least two signal transmitting passageways for conducting hydraulic fluid to actuate well tools comprising:

a mandrel having a longitudinal bore therethrough, an inner diameter, an outer diameter, and an outside circumference; and at least two signal transmitting passageways positioned in said mandrel between the inner diameter and the outer diameter.

12. A combination of a mandrel and at least two signal transmitting passageways for transmitting signals to actuate well tools comprising:

a mandrel having a longitudinal bore therethrough, an inner diameter, an outer diameter, and an outside circumference;

at least two signal transmitting passageways positioned in the mandrel between the inner diameter and the outer diameter; and an electric wire traversing the mandrel through one of the signal transmitting passageways.

13. A combination of a mandrel and at least two signal transmitting passageways for transmitting signals to actuate well tools comprising:

a mandrel having a longitudinal bore therethrough, an inner diameter, an outer diameter, and an outside circumference;

at least two signal transmitting passageways positioned in the mandrel between the inner diameter and the outer diameter; and a fiber optic cable traversing the mandrel through one of the signal transmitting passageways.

14. An improved packer comprising:

a first nipple having a longitudinal bore therethrough;

a first set of slips having inner surfaces and being connected to the first nipple and mating with a first gripping member;

a resilient sealing element having a longitudinal bore therethrough, and a first end connected to the first set of slips;

a body member connected to a second end of the resilient sealing element;

a piston having a longitudinal bore therethrough and being disposed for longitudinal movement within the body member;

a second nipple having a longitudinal bore therethrough and being connected to the body member; and a mandrel having a longitudinal bore therethrough, an inner diameter, an outer diameter, an outside circumference, and at least two signal transmitting passageways positioned in the mandrel between the inner diameter and the outer diameter, the outside circumference being disposed within: the longitudinal bore of the first nipple; the inner surfaces of the first set of slips; the longitudinal bore of the resilient sealing element; the longitudinal bore of the piston; and the longitudinal bore of the second nipple.

15. The improved packer of claim 14, further including a second set of slips for mating with a second gripping member, the second set of slips having inner surfaces and being connected between the body member and the second nipple, the outside circumference of the mandrel being further disposed within the inner surfaces of the second set of slips.

16. The improved packer of claim 14, wherein a first communication conduit is connected between a control panel at the earth's surface and the at least two signal transmitting passageways in the mandrel.

17. The improved packer of claim 16, wherein at least one signal is transmitted from the first communication conduit through one of the signal transmitting passageways in the mandrel to a second communication conduit, the second communication conduit being connected to a device below the packer.

18. The improved packer of claim 14, wherein the mandrel includes:

a first hydraulic passageway, a second hydraulic passageway, a fiber optic passageway, and an electric passageway;

the first hydraulic passageway establishing fluid communication between the piston and a source of hydraulic fluid above the packer;

the second hydraulic passageway establishing fluid communication between a source of hydraulic fluid above the packer and at least one device below the packer;

the fiber optic passageway providing a channel for passing at least one fiber optic cable from above the packer to at least one device below the packer; and the electric passageway providing a channel for passing at least one electrical conductor from above the packer to at least one device below the packer.

19. The improved packer of claim 14, wherein:

a first communication conduit is connected between a control panel at the earth's surface and the packer, the first communication conduit including a first hydraulic conduit, a second hydraulic conduit, at least one fiber optic cable, and at least one electrical conductor; and the mandrel includes a first hydraulic passageway in communication with the first hydraulic conduit in the first communication conduit, a second hydraulic passageway in communication with the second hydraulic conduit in the first communication conduit, a fiber optic passageway through which the at least one fiber optic cable passes, and an electric passageway through which the at least one electrical conductor passes.

20. The improved packer of claim 19, wherein:

a second communication conduit is connected between the packer and a device below the packer, the second communication conduit including a hydraulic conduit, at least one fiber optic cable, and at least one electrical conductor;

the second hydraulic passageway in the mandrel being in fluid communication with the hydraulic conduit in the second communication conduit;

the at least one electrical conductor passing through the electric passageway in the mandrel being connected to the at least one electrical conductor in the second communication conduit; and the at least one fiber optic cable passing through the fiber optic passageway in the mandrel being connected to the at least one fiber optic cable in the second communication conduit.

* * * * *